United States Patent [19]

Kiefer et al.

[11] 4,427,001

[45] Jan. 24, 1984

[54] ELECTRICAL FACIAL MASSAGE APPARATUS

[76] Inventors: Mercedes Kiefer, c/o George Spector 3615 Woolworth Bldg. 233 Broadway; George Spector, 3615 Woolworth Bldg. 233 Broadway, both of New York, N.Y. 10007

[21] Appl. No.: 211,080

[22] Filed: Nov. 28, 1980

[51] Int. Cl.[3] ..... A61H 29/00

[52] U.S. Cl. ..... 128/24.4; 128/57

[58] Field of Search ..... 128/57, 24.4, 24.3, 128/24.1, 67, 55

[56] References Cited

U.S. PATENT DOCUMENTS

| | | | |
|---|---|---|---|
| 1,573,693 | 2/1926 | Engstrom | 128/67 |
| 1,635,917 | 7/1927 | Wright | 128/55 |
| 1,974,031 | 9/1934 | Merill | 128/24.1 |
| 1,998,696 | 4/1935 | Andis | 128/55 |
| 2,709,432 | 5/1955 | Ackerman | 128/67 |
| 3,051,980 | 9/1962 | Rosenthal | 128/67 |

*Primary Examiner*—Richard C. Pinkham
*Assistant Examiner*—T. Brown

[57] ABSTRACT

An exercising device for a person's face, a front side of the device including a spoon shaped bowl for massaging against the face, an electric coil behind the bowl connected to a transformer for heating up the bowl surface, wiring from the transformer to a control switch on the handle and to an electric power source, while a rear side of the device includes a reservoir for oil or cream, and a sponge on which the oil or cream is dispensed.

1 Claim, 5 Drawing Figures

Fig. 1
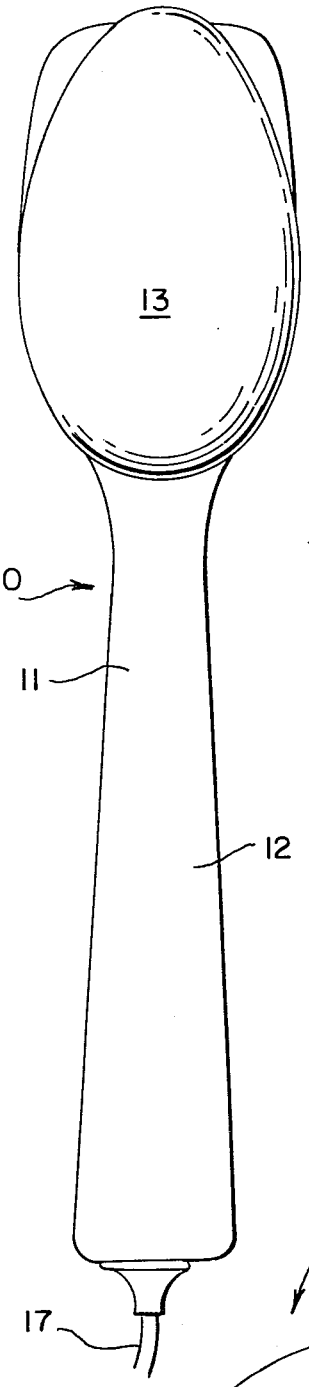
Fig. 2
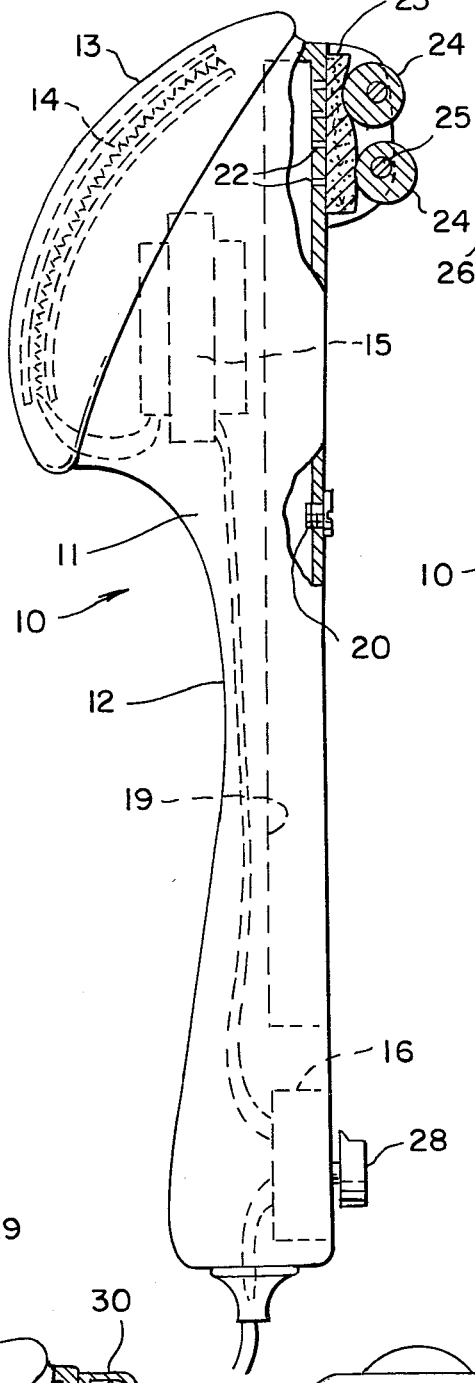
Fig. 3
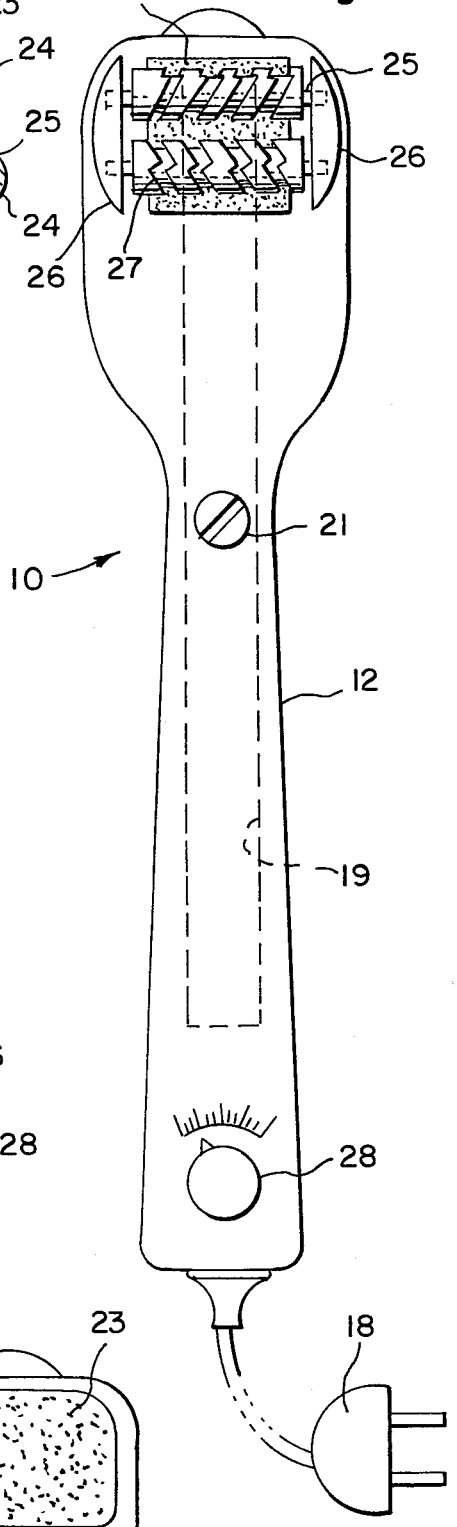
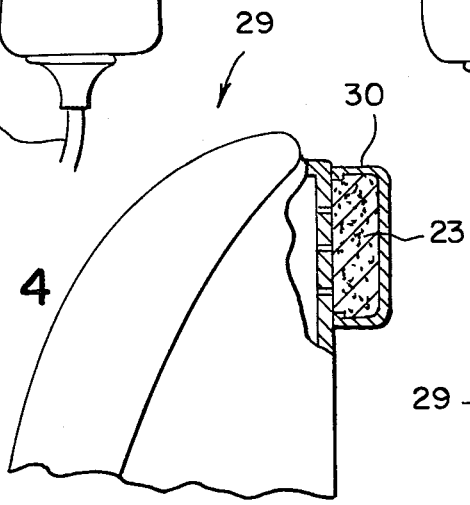
Fig. 4
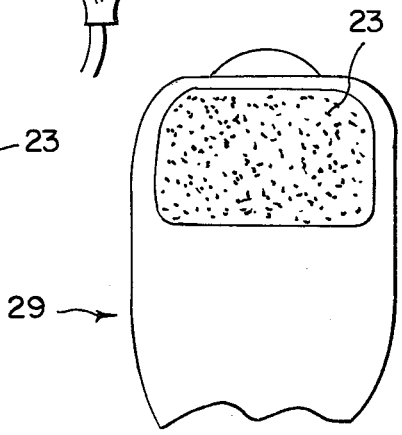
Fig. 5

ELECTRICAL FACIAL MASSAGE APPARATUS

This invention relates generally to massaging appliances.

It is well known that most persons are very concerned about the development of face wrinkles, which makes them look old. In these modern times, there is a great accent on youthfulness, and even the old thus try to keep the appearance of looking young. Enormous sums are spent on facial cosmetics to cover up or shrink wrinkles. Certainly nothing is better than prevent them being formed.

Accordingly, it is a principal object of the present invention to provide a massaging device that exercised the facial skin so that it remains muscularly taut and not sagging, and which improves blood circulation so that it is healthy vibrant in texture and color instead of looking shrivelled.

Another object is to provide an electro facial wonder which if used even for only a few minutes each day, will prevent small lines developing on a face, or if small lines have already developed, will prevent them from becoming deep ruts.

FIG. 1 is a front view of the invention.

FIG. 2 is a side view thereof shown partly in cross section so to indicate one design thereof wherein rollers rolling against the sponge transfer the lotion with a massaging action to a skin surface.

FIG. 3 is a rear view thereof.

FIG. 4 is a fragmentary side view of another design of the invention in which the sponge is shown fitted with a cover.

FIG. 5 is a fragmentary rear view thereof.

Referring now to the drawing in greater detail and more particularly to FIGS. 1 through 3 thereof, at this time, the reference numeral 10 represents an electro facial wonder according to the present invention, wherein there is an elongated main body 11 molded of hard plastic, and which includes a long handle 12 at one end for being held in a persons hand. A front side of an opposite end thereof has an aluminum plate 13, shaped like a bowl of a spoon which is outwardly convexed for massaging against a face.

The main body is hollow, and an electric coil 14 is directly behind the plate, the coil being connected by wiring to a transformer 15, that is connected by wiring to a rheostat control switch 16 along the handle, and an extension cord 17 therefrom extends out of an end of the handle, the extension cord having a plug 18 on its end for insertion into a household electric outlet socket.

Alternately, the device may be made in a model that is operated by batteries in the handle.

A reservoir 19 on a rear side of the main body has a filter opening 20, closable by a plug 21, and serves to receive oil or cream which can be dispensed from the reservoir through small openings 22 into a sponge 23 against which a pair of rollers 24 slide so as to pick up a thin film of the oil or cream and deposit it on a skin surface. Each roller is eccentrically mounted on a spin 25 supported between side walls 26 on a rear of the main body. Each roller has a plurality of zig-zagged annular grooves 27 therearound for massaging the skin by reciprocal sideward flexing of the skin as the roller is rolled thereacross.

In operative use the heat temperature of the coil is controlled by a knob 28 of the control switch. After the oil is rubbed on the skin, the heated plate is massaged against the skin, particularly at areas where crows feet, and wrinkles tend to form. Repeated and frequent use is beneficial.

In FIGS. 4 and 5, another design of electro facial wonder 29 does not include the above described rollers, but the oil or cream is applied directly from the sponge to the face. When not in use, a removable cover 30 of hard plastic or the like is snapped over the sponge so as to prevent getting such lotion accidently on other objects.

While various changes may be made in the detail construction, it is understood that such changes will be within the spirit and scope of the present invention as is defined by the appended claims.

What is claimed:

1. An electro facial therapeutic device, comprising in combination, an elongated main body having a handle at one end, a plate shaped like spoon at an opposite end of said main body, said oposite end having a vibratory applicator at a rear side of said opposite end and electric heating means inside said main body for selectively heating said plate, said plate having a convex surface at the front side of said plate wherein said heating means comprises an electric heating coil located adjacent the convex surface wherein said applicator includes a reservoir for applicator material and exterior sponge and rollers for applying said material from said reservoir via perforations through said reservoir adjacent said sponge wherein the rollers abutt the sponge and are eccentrically mounted on said device, said rollers include zig zag grooves for laterally flexing the user's skin.

* * * * *